US010251799B2

(12) United States Patent
Ryberg

(10) Patent No.: US 10,251,799 B2
(45) Date of Patent: Apr. 9, 2019

(54) BATHING AID

(71) Applicant: Robotics Care AB, Djursholm (SE)

(72) Inventor: Thomas Ryberg, Djursholm (SE)

(73) Assignee: ROBOTICS CARE AB (SE)

( * ) Notice: Subject to any disclaimer, the term of this patent is extended or adjusted under 35 U.S.C. 154(b) by 0 days.

(21) Appl. No.: 15/540,363

(22) PCT Filed: Nov. 27, 2015

(86) PCT No.: PCT/EP2015/077944

§ 371 (c)(1),
(2) Date: Jun. 28, 2017

(87) PCT Pub. No.: WO2016/107712

PCT Pub. Date: Jul. 7, 2016

(65) Prior Publication Data

US 2017/0348169 A1 Dec. 7, 2017

(30) Foreign Application Priority Data

Nov. 29, 2014 (EP) ..... 14200398

(51) Int. Cl.
*A61G 7/10* (2006.01)

(52) U.S. Cl.
CPC ..... *A61G 7/1003* (2013.01); *A61G 7/1059* (2013.01); *A61G 2203/44* (2013.01)

(58) Field of Classification Search
CPC .. A61G 7/1003; A61G 7/1034; A61G 7/1025; A61G 7/1032; A47K 3/285; A47K 3/36; A47K 3/362

(Continued)

(56) References Cited

U.S. PATENT DOCUMENTS 4,606,082 A * 8/1986 Kuhlman ..... A61G 5/00 280/304.1
4,888,834 A * 12/1989 Vago ..... A47K 3/007 4/540

(Continued)

FOREIGN PATENT DOCUMENTS

CN 203354886 U 12/2013
EP 0449429 A2 10/1991

(Continued)

OTHER PUBLICATIONS

Machine Translation of EP '972.*

*Primary Examiner* — Erin Deery
(74) *Attorney, Agent, or Firm* — Condo Roccia Koptiw LLP

(57) ABSTRACT

A bathing aid (100), comprising a bathing enclosure (101), a telescopic element (110) arranged at least partially within the bathing enclosure, and a seat (120) for supporting a person, said seat being arranged on the telescopic element. The bathing aid further comprises an actuation system (140) coupled to the telescopic element and the seat. The actuation system is configured to move the seat on the telescopic element along a horizontal axis (x) between a retracted position of the seat within the bathing enclosure and an extended position of the seat outside the bathing enclosure. The actuation system, in the extended position of the seat, is further configured to rotate (A) the seat in a horizontal plane (x-y) and configured to tilt (C) the seat with respect to a vertical axis (z).

14 Claims, 7 Drawing Sheets

(58) Field of Classification Search
USPC ..... 4/560, 560.1, 562.1, 563.1, 565.1, 566.1
See application file for complete search history.

(56) References Cited

U.S. PATENT DOCUMENTS

| | | | | |
|---|---|---|---|---|
| 5,146,638 | A * | 9/1992 | Richards | A61G 7/1003 4/562.1 |
| 5,287,568 | A | 2/1994 | Mohrmann | |
| 5,647,071 | A * | 7/1997 | Suzuki | A47K 3/006 4/555 |
| 7,107,630 | B2 * | 9/2006 | Noro | A47K 3/007 4/540 |
| 7,155,758 | B1 * | 1/2007 | Berke | E03C 1/046 239/282 |
| 7,393,053 | B2 * | 7/2008 | Kurrasch | A47C 1/0242 297/217.3 |
| 7,537,069 | B2 * | 5/2009 | Kramer | A47C 7/62 180/21 |
| 2004/0231043 | A1 | 11/2004 | Sherlock et al. | |
| 2006/0260041 | A1 * | 11/2006 | Paz | A61H 7/001 4/573.1 |
| 2011/0258771 | A1 | 10/2011 | Hammer et al. | |
| 2011/0283449 | A1 | 11/2011 | Baxley | |

FOREIGN PATENT DOCUMENTS

| | | | |
|---|---|---|---|
| EP | 1029525 | A2 | 8/2000 |
| EP | 1523972 | A1 | 4/2005 |
| WO | WO 96/10982 | A1 | 4/1996 |
| WO | WO 2006/075351 | A1 | 7/2006 |

* cited by examiner

BATHING AID

CROSS REFERENCE TO RELATED APPLICATIONS

This application is the National Stage Entry under 35 U.S.C. § 371 of Patent Cooperation Treaty Application No. PCT/EP2015/077944, filed 27 Nov. 2015, which claims the benefit of European Application No. 14200398.7, filed 29 Dec. 2014, the contents of which are hereby incorporated by reference herein.

FIELD OF THE INVENTION

This invention relates to a bathing aid, in particular for the purpose of assisting an elderly, disabled, injured and/or mobility-impaired person when bathing.

BACKGROUND OF THE INVENTION

Bathing procedures are often problematic for elderly and/or disabled persons due to several reasons. Firstly, it should be noted that bathing arrangements such as showers and bathtubs are usually designed for the non-disabled, and especially entering and exiting these arrangements may be related to severe difficulties for disabled persons. Secondly, it will be appreciated that the bathroom environment itself may be potentially dangerous, e.g. when considering that bathroom floors may be hard and slippery. Hence, taking a shower or a bath may be hazardous for elderly and/or disabled persons, and may in some cases result in physical injuries. Consequently, many people may be forced to bathe less frequently to avoid the risks related thereto. Alternatively, help must be obtained of one or more assistants in the bathroom, especially when entering or exiting the shower or bathtub. However, the assisting staff may hereby be exposed to heavy and/or awkward lifting when helping the person, and the staff may hereby also run the risk of being injured. Furthermore, the need of assistance when undressing and/or taking care of one's personal hygiene may be embarrassing and/or humiliating for the bather.

In light of the above observations, there is an increasing need for an arrangement which is able to provide a safe and convenient assistance to elderly and/or disabled persons regarding shower or bath accessibility.

US2011/0283449 describes a system and apparatus for assisting a person during entering and exiting a bathtub and shower. The system comprises a bathtub chair system having a support member having a first end coupled to the first side of the bathtub, extending across and beyond the second side of the bathtub to a base member at the second end of the support member. The system further comprises a seating surface disposed on the support member, an electric motor disposed within the base member and a drive member coupling the seating surface to the electric motor.

However, the system as described does not provide a convenient access of an elderly and/or disabled person to the bathtub. Hence, alternative solutions are of interest, such that a safe and convenient assistance to elderly and/or disabled persons regarding shower or bath accessibility may be provided.

SUMMARY OF THE INVENTION

It is an object of the present invention to mitigate the above problem, and to provide an arrangement which is able to achieve a safe and convenient bath or shower access.

This and other objects are achieved by providing a bathing aid having the features defined in the independent claim. Preferred embodiments are defined in the dependent claims.

Hence, according to the present invention, there is provided a bathing aid comprising a bathing enclosure. The bathing aid further comprises a telescopic element arranged at least partially within the bathing enclosure, wherein the telescopic element is extendable and retractable along a horizontal axis. The bathing aid further comprises a seat for supporting a person, said seat being arranged on the telescopic element. The bathing aid further comprises an actuation system coupled to the telescopic element and the seat. The actuation system is configured to move the seat on the telescopic element along the horizontal axis between a retracted position of the seat within the bathing enclosure and an extended position of the seat outside the bathing enclosure. The actuation system, in the extended position of the seat, is further configured to rotate the seat in a horizontal plane and configured to tilt the seat with respect to a vertical axis.

The bathing aid according to the present invention provides a safe and conveniently accessible arrangement for showering, bathing and/or washing a person, and is particularly suitable for elderly and/or disabled persons. The seat of the bathing aid, which seat is arranged on the telescopic element, is movable by means of the actuation system back and forth between the retracted position of the seat within the bathing enclosure in which the person is showered, bathed and/or washed, and the extended position of the seat outside the bathing enclosure, in which the person sits up on the seat before the showering and/or bathing or leaves the seat after the showering and/or bathing. The bathing aid is hereby configured to provide a convenient access of a person to the seat before his/her showering and/or bathing, and analogously, a convenient leaving of the seat of the person after the showering and/or bathing. The bathing aid is furthermore configured to gently and conveniently transport the person from a position outside the bathing enclosure into the bathing enclosure, where the showering and/or bathing procedure takes place. After said procedure, the bathing aid is configured to gently and conveniently transport the person back into the position outside the bathing enclosure. In the extended position of the seat outside the bathing enclosure, the actuation system of the bathing aid is configured to rotate the seat in a horizontal plane. The bathing aid hereby facilitates the action of the person to sit upon the seat, and leave the seat, respectively, in an easy and convenient manner. Furthermore, as the actuation system of the bathing aid is configured to tilt the seat with respect to a vertical axis, the bathing aid even further facilitates the manner in which the person may sit upon the seat, and leave the seat, respectively.

An advantage of the present invention is that a person may be able to shower and/or bathe in a safe, reliable and convenient manner. It will be appreciated that the bathing aid is configured to transport a person back and forth between a position outside the bathing enclosure and a position inside the bathing enclosure. Hence, the bathing aid supports the person's bathing and/or shower procedure in that it inhibits the occurrences of accidents when bathing and/or showering such as slipping and/or falling accidents. Due to the safe, reliable and convenient transportation of a person by means of the bathing aid, the present invention provides a safe bathing and/or shower procedure, especially for elderly and/or disabled persons. Furthermore, as the actuation system of the bathing aid of the present invention is configured to rotate the seat in a horizontal plane and to tilt the seat with respect to a vertical axis, the seat of the bathing aid is able to receive and to support the person in a safe and reliable way when the person intends to sit upon the seat. Analogously, the bathing aid is configured to rotate and/or tilt the seat to provide a safe and reliable operation when the person intends to leave the seat. It should be noted that the ability of the actuation system of the bathing aid to tilt the seat is particularly advantageous when the person intends to leave the seat, as the movement from an otherwise substantially horizontal position when sitting to a standing position may be particularly difficult for an elderly and/or disabled person. Furthermore, as the bathing aid is able to tilt and/or rotate the seat, the bathing aid is especially beneficial for persons who suffer from a stroke, as the mobility of their left or right side of the body may be impaired.

Another advantage of the present invention is that a person may assist himself/herself when bathing and/or showering without the need of help from one or more assistants. This is understood as the bathing aid is configured to transport the person between a position outside the bathing enclosure and a position inside the bathing enclosure, and back again, and wherein the bathing aid furthermore provides an easy and convenient access to and/or sitting on the seat as well as an easy and convenient rising from the seat for the person. Hence, the bathing aid of the present invention may avoid the need of one or more assistants, which is economically beneficial.

Another advantage of a person's ability to assist himself/herself when bathing and/or showering without the need of assistant help is that the risk of injures of assistant staff may hereby be avoided. It will be appreciated the bathing aid of the present invention avoids the risk of exposing assistant staff to heavy and/or awkward lifting when helping the person, as the bathing aid provides an arrangement by which the person may bathe/shower autonomously.

It will be appreciated that the need of assistance when undressing and/or taking care of one's personal hygiene may be embarrassing and/or humiliating for the bather. Hence, another advantage of the present invention is that the bathing aid provides intimacy for the bathing person, as no personal assistance is needed for the person intending to take a bath and/or shower.

The bathing aid comprises a bathing enclosure. By the term "bathing enclosure", it is here meant substantially any (shower) cabin, cabinet, cubicle, booth, (bath) tub, or the like. The bathing aid further comprises a telescopic element arranged at least partially within the bathing enclosure. By the term "telescopic element", it is here meant an element which is able to become longer (extended) or shorter (retracted), e.g. by having sections that slide inside one another. The telescopic element is extendable and retractable along a substantially horizontal axis. The bathing aid further comprises a seat for supporting a person, wherein the seat is arranged on the telescopic element. By the term "seat", it is here meant substantially any kind of element for supporting a person in a sitting position. The bathing aid further comprises an actuation system coupled to the telescopic element and to the seat. By the term "actuation system", it is here meant substantially any system, arrangement and/or device configured, arranged and/or adapted to actuate, drive, move and/or run any element(s) coupled thereto. The actuation system is configured, arranged and/or adapted to move the seat on the telescopic element along the (substantially) horizontal axis between a retracted position of the seat within the bathing enclosure and an extended position of the seat outside the bathing enclosure, and back again. In other words, the actuation system is configured to move the telescopic element upon which the seat is arranged. By the term "configured", it is here meant that the actuation system is arranged, adapted and/or able to perform an action (e.g. a rotation and/or tilting of the seat), but is not forced to do so if not needed and/or desired. In the extended position of the seat, the actuation system is configured, arranged, adapted and/or able to rotate the seat in a (substantially) horizontal plane. It will be appreciated that the actuation system hereby is able to perform a rotation of the seat in the horizontal plane if needed and/or desired.

Furthermore, in the extended position of the seat, the actuation system is configured, arranged, adapted and/or able to tilt the seat with respect to a (substantially) vertical axis. It will be appreciated that the actuation system hereby is able to perform a tilting of the seat with respect to the vertical axis if needed and/or desired. Hence, the actuation system is configured to tilt the seat with respect to the vertical axis, but is not forced to do so if not needed and/or desired.

According to an embodiment of the present invention, the actuation system may be configured to move the seat in the extended position along the vertical axis. In other words, the actuation system may be configured, arranged, adapted and/or able to move and/or adjust the seat, in its extended position, along the vertical axis. The present embodiment is advantageous in that the actuation system of the bathing aid hereby is configured to adjust the height of the seat of the bathing aid. The bathing aid may hereby be configured to adjust the height of the seat to suit the person wishing to use the bathing aid. The present embodiment is advantageous in that the bathing aid is hereby able to an even further extent provide a safe and conveniently accessible arrangement for showering, bathing and/or washing a person.

According to an embodiment of the present invention, the bathing aid may further comprise at least one control unit communicatively coupled to the actuation system, wherein the control unit may be configured to control the movement of the seat. By the term "communicatively coupled", it is here meant substantially any coupling and/or link (e.g. by wire or wireless) through which a communication may be established. By the term "control unit", it is here meant substantially any unit, system, arrangement and/or device configured, arranged, adapted and/or able to control the movement, motion and/or positioning of the seat, e.g. by feedback. Hence, the control unit of the bathing aid may be configured to control the movement of the seat via the actuation system. The present embodiment is advantageous in that the bathing aid may adapt the movement of the seat according to one or more conditions, such that the bathing aid may even further facilitate the manner in which the person may sit upon the seat, be moved into (out of) the bathing enclosure and/or leave the seat, respectively.

According to an embodiment of the present invention, the at least one control unit, in the extended position of the seat, may be configured to position the seat according to a predetermined positioning of the seat. By the term "positioning", it is here meant a positioning of the seat in relation to the extended position of the seat. For example, in the extended position of the seat, the control unit may be configured to position the seat by a rotation of the seat in the horizontal plane, by a tilting of the seat with respect to the vertical axis and/or by a movement of the seat along the vertical axis, according to a predetermined positioning of the seat. The present embodiment is advantageous in that the bathing aid may position the seat according to a desired positioning of the seat, e.g. to meet the demands of a person who intends to use the bathing aid. The present embodiment hereby even further simplifies and/or facilitates the manner in which the person may sit upon the seat and/or leave the seat, respectively.

According to an embodiment of the present invention, the at least one control unit may be manually operable. By the term "manually operable", it is here meant that the control unit may be operable by the person using and/or intending to use the bathing aid. Alternatively, the control unit may be operable by any other person, such as an assistant. The present embodiment is advantageous in that the person using and/or intending to use the bathing aid and/or one or more assistants may control the movement and/or positioning of the seat.

According to an embodiment of the present invention, the at least one control unit may be arranged on the seat and wherein the control unit may be manually operable by a person sitting on the seat. For example, the control unit may be arranged on an arm rest of the seat. The present embodiment is advantageous in that a person sitting on the seat of the bathing aid may conveniently control the movement and/or positioning of the seat.

According to an embodiment of the present invention, the bathing aid may further comprise a detection unit communicatively coupled to the at least one control unit, wherein the detection unit is configured to detect the position of a person in relation to the seat, and wherein the at least one control unit is configured to position the seat according to the detected position of the person. In other words, the detection unit is configured, arranged, adapted and/or able to detect the position of a person. Based on the detected position of the person, the control unit is configured, arranged, adapted and/or able to position the seat according to the detected position. The present embodiment is advantageous in that the bathing aid, by means of the control unit, is able to position the seat relative the person to even further facilitate the manner in which the person may sit upon the seat. The present embodiment is further advantageous in that the safety of the bathing aid is increased even further, as the control unit may be configured to stop the movement of the seat in case the control unit has detected that the seat otherwise may collide with the person who intends to use the bathing aid.

According to an embodiment of the present invention, the seat may comprise at least one armrest arranged in a first direction alongside the seat, and wherein the actuation system is configured to move the at least one armrest between the first direction and a second direction different from the first direction. By the term "direction alongside the seat", it is here meant a substantially horizontal direction alongside the seat. The actuation system is hereby configured, arranged, adapted and/or able to move the at least one armrest away from the first direction alongside the seat into any other second direction, and back again. For example, the actuation system may be configured to move the at least one armrest between a (horizontal) position alongside the seat and a vertical position of the at least one armrest. Alternatively, the actuation system may be configured to move the at least one armrest between a (horizontal) position alongside the seat to a position which extends laterally outward relative to the seat. It will be appreciated that the actuation system hereby may be configured to move away the at least one armrest when a person intends to sit upon the seat, such that the bathing aid hereby mitigates an obstruction by the armrest. Hence, the present embodiment is advantageous in that the bathing aid may even further facilitate the person's access to the seat and/or the manner in which the person may sit upon and/or leave the seat.

According to an example of the present invention, the seat may comprise at least one collision sensor configured to sense a presence and/or a position of an object and to avoid a collision between at least a portion of the seat and the object. For example, the seat may comprise one or more collision sensors configured to sense a presence and/or position of a person intending to take a bath and/or shower and to avoid a collision between at least a portion of the seat and the person. As yet another example, the seat may comprise one or more collision sensors configured to avoid a collision between at least one armrest and a person. More specifically, in the case the actuation system is configured to move the at least one armrest of the seat, the collision sensor(s) may be configured to avoid a collision between the armrest(s) and the person. Consequently, the collision sensor(s) hereby mitigate an impact between the armrest(s) and the person and/or a squeezing, pinching and/or clamping of the person by the armrest(s). The present embodiment is advantageous in that it provides and even safer and more convenient bathing aid for showering, bathing and/or washing a person.

According to an embodiment of the present invention, the seat may comprise at least one weight sensor for sensing the weight of a person sitting on the seat. The at least one weight sensor may be provided, arranged and/or distributed on and/or in the seat such that the weight sensor(s) may determine the distribution of the weight of the person on the seat. The present embodiment is advantageous in that the bathing aid may be configured to determine the position of the person on the seat. For example, the bathing aid may be configured to determine if a person sits correctly or incorrectly on the seat.

According to an embodiment of the present invention, the at least one weight sensor may be communicatively coupled to the actuation system, and wherein the actuation system may be configured to move the seat as a function of the weight of a person sitting on the seat. In other words, the actuation system of the bathing aid may be configured, arranged, adapted and/or able to move the seat based on (as a function of) the weight and/or weight distribution of the person on the seat. For example, the bathing aid may be configured to determine that a person sits correctly or incorrectly on the seat. The bathing aid may hereby be configured to move the seat based on this information, and may be configured to move the seat if the person seems to be correctly seated on the seat and stop the movement if the person seems to be incorrectly seated on the seat. The present embodiment is advantageous in that the bathing aid is even further improved in terms of safety for the bathing person.

According to an embodiment of the present invention, the bathing enclosure may comprises a side wall being openable and closable, and wherein the actuation system is configured to open the side wall before the seat is moved from the retracted position of the seat within the bathing enclosure to the extended position of the seat outside the bathing enclosure, and to close the side wall after the seat has been moved from the extended position of the seat outside the bathing enclosure to the retracted position of the seat within the bathing enclosure. The present embodiment is advantageous in that the actuation system is may be configured, arranged, adapted and/or able to (automatically) open and close the side wall dependent on the movement and/or position of the seat without the need of the person sitting on the seat to open and/or close the side wall.

According to an embodiment of the present invention, there is provided a bathing arrangement comprising a bathing aid according to any one of the previous embodiments and a water supply system for a supply of water to the bathing enclosure. It will be appreciated that the water supply system may be substantially any system for supplying water to the bathing enclosure. For example, the water supply system may be arranged and/or formed as a shower system, e.g. comprising one or more (shower) nozzles. Alternatively, the water supply system may be arranged and/or formed as a bath system, e.g. comprising one or more taps to at least partially fill the bathing enclosure with water. The present embodiment is advantageous in that a person sitting on the seat within the bathing enclosure may easily and conveniently take a shower and/or take a bath by means of the water supply system, wherein the water supply system may be automatically and/or manually operated.

According to an embodiment of the present invention, the bathing arrangement may comprise a product supply system for a supply of at least one body cleaning product to said bathing enclosure. It will be appreciated that the product supply system may be substantially any automatically and/or manually operated system for supplying at least one body cleaning product to the bathing enclosure. By the term "body cleaning product", it is here meant substantially any product for the purpose of cleaning and/or washing the body, such as soap, shampoo, (hair) conditioner, etc. The present embodiment is advantageous in that the automatically and/or manually product supply system is configured and/or arranged to easily and conveniently supply at least one body cleaning product to a person sitting on the seat within the bathing enclosure.

According to an embodiment of the present invention, the bathing arrangement may comprise at least one nozzle arranged within the bathing enclosure for the purpose of cleaning a person sitting on the seat of the bathing aid. It will be appreciated that one or more nozzles may be coupled to the water supply system and/or the product supply system according to one or more the aforementioned embodiments. Furthermore, the at least one nozzle may be arranged at various positions within the bathing enclosure for cleaning different areas of the person using the bathing arrangement. The present embodiment is advantageous in that a person sitting on the seat within the bathing enclosure may be efficiently and conveniently cleaned by water and/or body cleaning product(s) at one or more areas of his/her body.

According to an embodiment of the present invention, there is provided a bathing system comprising a bathing arrangement according to any one of the previous embodiments. The bathing system further comprises a control system communicatively coupled to the water supply system and to the product supply system, wherein the control system is configured to control the supply of water and body cleaning product to the bathing enclosure. The control system may be manually or automatically operated and may furthermore be configured to control the supply of water according to a predetermined cleaning program. By the term "predetermined cleaning program", it is here meant a program set in advance for cleaning a person sitting on the seat. For example, the program may include a water supply which is dependent on time, amount of water, position of one or more nozzles, etc. In other words, there is provided a predetermined cleaning program according to (as a function of) which the control system is configured, arranged, adapted and/or able to control the supply of water and body cleaning product from the water and the product supply systems, respectively. The present embodiment is advantageous in that a person sitting on the seat within the bathing enclosure may take a shower and/or a bath without the need of any manual intervention. Alternatively, the control system may be manually operable by the person using and/or intending to use the bathing aid, or be operable by any other person, such as an assistant, on the outside of the bathing enclosure. It will be appreciated that the control system may be communicatively coupled to and/or integrated with the control unit according to any previous embodiment.

Further objectives of, features of, and advantages with the present invention will become apparent when studying the following detailed disclosure, the drawings and the appended claims. Those skilled in the art realize that different features of the present invention can be combined to create embodiments other than those described in the following.

BRIEF DESCRIPTION OF THE DRAWINGS

This and other aspects of the present invention will now be described in more detail, with references to the appended drawings showing embodiments of the invention.

All the figures are schematic, not necessarily to scale, and generally only show parts which are necessary in order to elucidate the invention, wherein other parts may be omitted or merely suggested.

DETAILED DESCRIPTION

Figure 1:
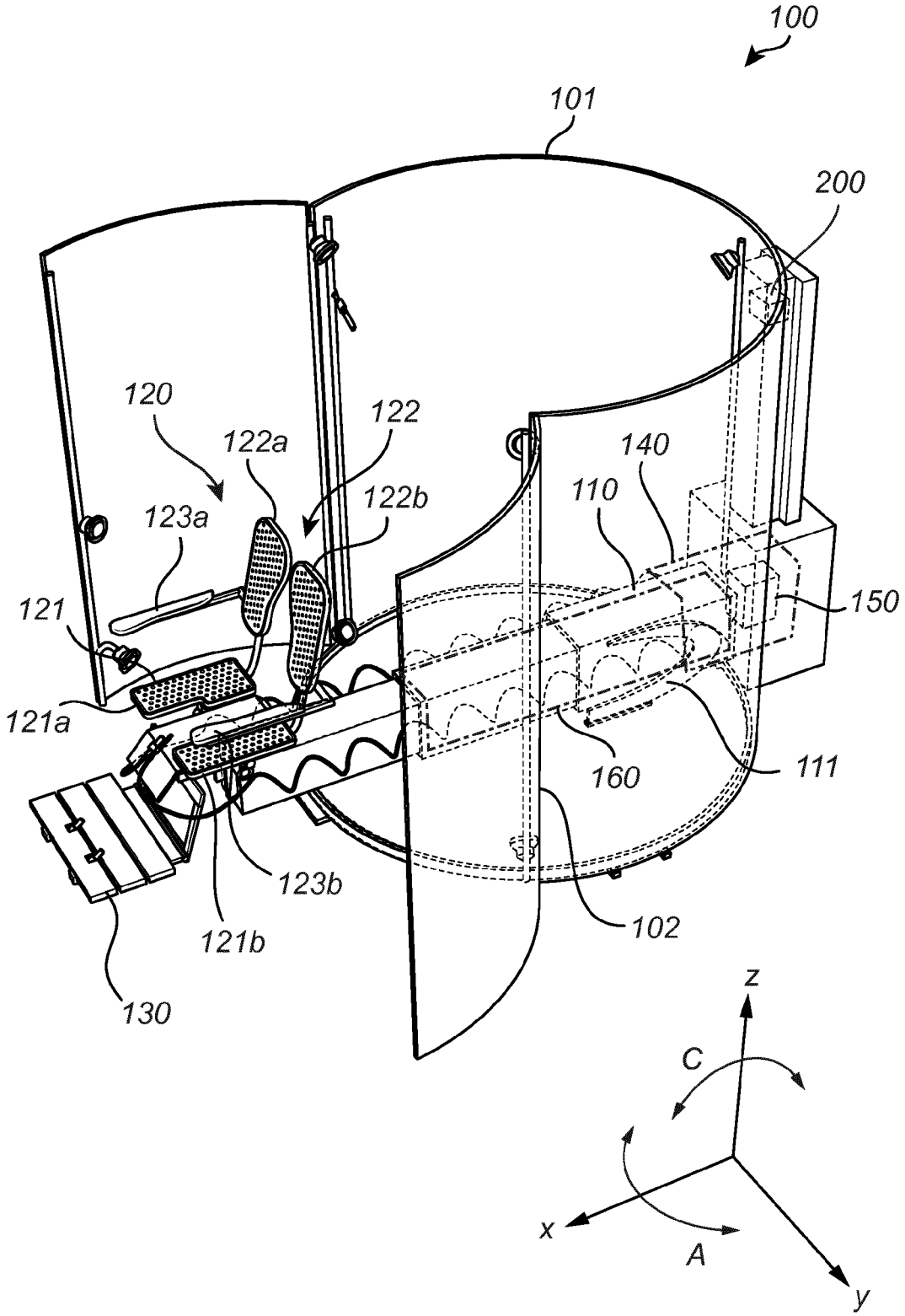
FIG. 1 shows a schematic illustration of a bathing aid according to the present invention.

FIG. 1 shows a schematic illustration of a bathing aid 100 according to the present invention. The bathing aid 100 comprises a bathing enclosure 101. The bathing enclosure 101 in FIG. 1 is exemplified as a (shower) cabin having the shape of a cylinder with an open top. Alternatively, the bathing enclosure 101 may be a cabinet, cubicle, booth, (bath) tub, or the like. The bathing enclosure 101 may comprise an at least partially transparent material, e.g. plexiglass, glass, plastics, or the like. In case of a substantially round bathing enclosure 101, as shown in FIG. 1, the diameter of the bathing enclosure 101 may be approximately 1000-1400 mm, preferably about 1200 mm.

Figure 2A:
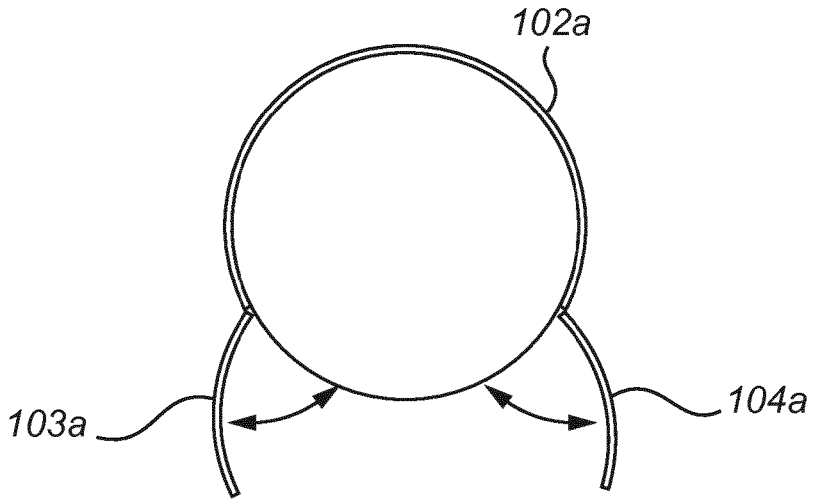
FIGS. 2*a*-2*b* show schematic illustrations of side walls of the bathing aid according to embodiments of the present invention.
Figure 2B:
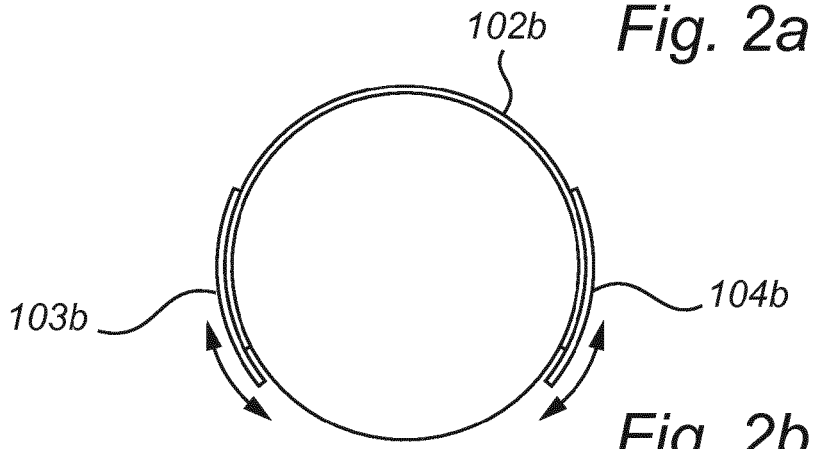

The bathing enclosure 101 comprises a side wall 102 being openable and closable. FIGS. 2*a-b* show schematic illustrations of examples of the side wall 102 of the bathing enclosure 101 from above. In FIG. 2*a*, the side wall 102*a* comprises a first portion 103*a* and a second portion 104*a* which may be opened outwards from the side wall 102*a* as doors. Alternatively, and as shown in FIG. 2*b*, the side wall 102*b* may comprise a first portion 103*b* and a second portion 104*b* which may be slidingly engaged with, or in relation to, the side wall 102*b*. However, the skilled person realizes that other arrangements of the side wall 102 than those shown in FIGS. 2*a-b* are feasible. It will be appreciated that the side wall 102 may be manually or automatically openable and closable. The side wall 102 may furthermore comprise one or more sensors for sensing if the side wall 102 is correctly closed.

According to FIG. 1, the bathing aid 100 further comprises a telescopic element 110, wherein a base portion 111 of the telescopic element 110 is fastened to the floor of the bathing aid 100. The telescopic element 110 is extendable and retractable along a horizontal axis x, indicated in the disclosed Cartesian coordinate system. The telescopic element 110 in FIG. 1 is able to become longer (extended) or shorter (retracted) by sections which slide inside one another. However, it should be noted that other realizations of the telescopic element 110 may be feasible. In FIG. 1, the telescopic element 100 is positioned in its extended position for a convenient access to the seat for a person before the showering and/or bathing or for a release of the person after the showering and/or bathing. It will be appreciated that the telescopic element 110 in its extended position is constructed to support a load of approximately 250 kg. The telescopic element 110 may furthermore be provided with a water tight cover.

The bathing aid 100 further comprises a seat 120 for supporting a person, wherein the seat 120 is arranged on (fastened to) the telescopic element 110. The seat 120 comprises a seat portion 121 to support a person in the seated position, a back rest 122 arranged substantially perpendicular to the seat portion 121 and two armrests 123*a,b* arranged alongside the seat portion 121.

In FIG. 1, the seat portion 121 comprises two separated parts 121*a,b* arranged in parallel, thereby defining a space between them. The back rest 122 also comprises two parts 122*a, b* arranged in parallel such that a space is defined between them. The seat 120 further comprises a footrest 130 arranged below the seat portion 121, wherein the surface of the footrest 130 is substantially parallel with the surface of the seat portion 121. The footrest 130 may furthermore comprise one or more legs (not shown) protruding from the footrest 130 downwards, such that they are arranged to come into contact with the floor inside or outside the bathing enclosure 101. The footrest 130 may be configured to retract automatically to a position under the seat 120 when the seat 120 is in its retracted position. Analogously, the footrest 130 may be configured to extend automatically from the position under the seat 120 when the seat 120 is in its extended position.

The bathing aid 100 further comprises a schematically indicated actuation system 140 coupled to the telescopic element 110 and the seat 120. The actuation system 140, which is configured to move the telescopic element 110 and, consequently, also the seat 120 arranged on the telescopic element 110, comprises a power system 150 and a drive system 160. The power system 150, which may comprise one or more electronic cards (printed circuit cards), software, etc., is provided in a housing arranged on the side wall 102 of the bathing aid 100 on the outside of the bathing enclosure 101. The drive system 160, which may comprise one or more motor arrangements, couplings, gears, etc., is arranged at least partly within the telescopic element 110. The power system 150 and the drive system 160, as well as the connections between them, are hereby sealed from water. It will be appreciated that further details of the power system 150 and drive system 160 of the bathing aid 100, as well as the coupling between the two, is omitted, since such details are well known to the skilled person.

The actuation system 140 of the bathing aid 100 is configured to move the seat 120, which is arranged on the telescopic element 110, along the horizontal axis x between a retracted position of the seat 120 within the bathing enclosure 101 and an extended position of the seat 120 outside the bathing enclosure 101. Analogously, the actuation system 140 of the bathing aid 100 is configured to move the seat 120 arranged on the telescopic element 110 along the horizontal axis x between the extended position of the seat 120 outside the bathing enclosure 101 to the retracted position of the seat 120 inside the bathing enclosure 101. The time for extending the telescopic element 110 from the retracted position to the extended position (or vice versa) is approximately 30-40 seconds. Hence, the actuation system 140 is configured to extend (retract) the telescopic element relatively slowly, which is beneficial for safety reasons for a person sitting on the seat 120.

The actuation system 140 of the bathing aid 100, in the extended position of the seat 120, is configured to rotate the seat 120 in a direction A in a horizontal plane, i.e. the x-y plane. For example, the actuation system 140 may be configured to rotate the seat approximately +90° to −90°, such as +45° to −45° in the direction A in the horizontal plane x-y. Furthermore, the actuation system 140 of the bathing aid 100, in the extended position of the seat 120, is configured to tilt the seat 120 in the direction C with respect to a vertical axis z in the Cartesian coordinate system. For example, the actuation system 140 may be configured to tilt the seat forwards approximately 0-45°, such as 0-30°, in the direction C. Furthermore, the actuation system 140 may be configured to tilt the seat backwards approximately 0-25°, such as 0-15°, in the direction C. It will be appreciated that the seat in its initial positioning may be inclined (tilted) backwards, e.g. 0-15°, to ensure a safe positioning of the person on the seat.

In FIG. 1, the actuation system 140 of the bathing aid 100 is configured to move the seat 120, in its extended position, along the vertical axis z in the Cartesian coordinate system. In other words, the bathing aid 100 is configured to adjust the height of the seat 120. For example, the bathing aid 100 may be configured to adjust the height of the seat portion 121 of the seat 120 to approximately 35-60 cm, such as 42-52 cm, above the floor level.

The bathing aid 100 as exemplified in FIG. 1 further comprises a schematically indicated control unit 200 which is communicatively coupled (by wire or wirelessly) to the actuation system 140. The control unit 200 is configured to control the movement of the seat 120. It will be appreciated that the control unit 200 may be automatically or manually operable. The control unit 200 may be arranged on the outside of the bathing enclosure 101. In case of a manual operation, a person outside the bathing enclosure 101 (e.g. the bathing person or an assistant) may control the movement of the seat 120 by means of the control unit 200. Alternatively, the control unit 200 may be arranged on the inside of the bathing enclosure 101, such that the person 130 sitting on the seat 120 (i.e. the bathing person) may control the movement of the seat 120. For example the control unit 200 may be arranged on an arm rest 123*a,b* of the seat 120 for a convenient control of the seat 120 by the person 130 sitting on the seat 120.

Figure 3:
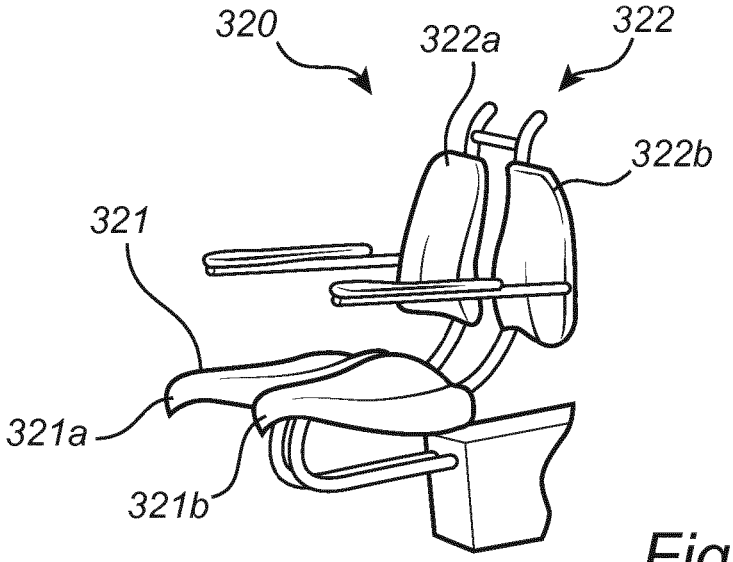
FIG. 3 shows a schematic illustration of a seat of the bathing aid according to an embodiment of the present invention.

FIG. 3 shows a schematic illustration of a seat 320 of the bathing aid according to an embodiment of the present invention. It will be appreciated that the seat 320 in FIG. 3 comprises the features and components of the seat 120 in FIG. 1. The seat portion 321 comprises two cup-shaped, separated parts 321*a,b* arranged in parallel, thereby defining a space between them. The back rest 322 also comprises two parts 322*a,b* arranged in parallel such that a space is defined between them. The back seat 322 may have an arched, convex shape which bulges towards the back of a person sitting on the seat 320. The seat 320 preferably comprises a water resistant material, e.g. polyurethane, plastics or glass fiber. The seat 320 is preferably resistant to body cleaning products such as soap, shampoo, (hair) conditioner, etc., as well as surfactants, mold, cleaning agents, etc. The seat 320 is hereby configured for exposure to a warm, humid and/or wet environment and is configured to withstand fluids and/or liquid products. Furthermore, the seat 320 is preferably resistant to body excrements such as faeces, urine, sweat, etc., and the seat 320 is also easily and conveniently cleanable from such body excrements. It will be appreciated that the seat 320 as exemplified may be comprised in the bathing aid according to any embodiment of the present invention.

Figure 4:
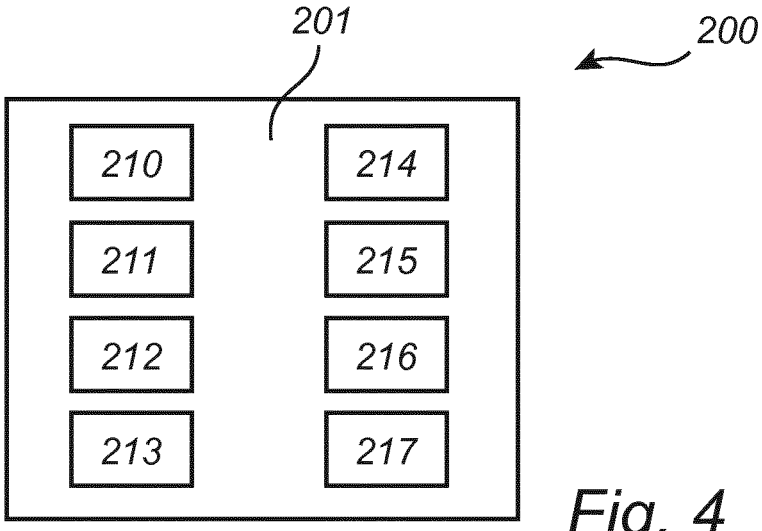
FIG. 4 shows a schematic illustration of a control unit according to an embodiment of the present invention.

FIG. 4 shows a schematic illustration of a control unit 200 according to an embodiment of the present invention. The control unit 200 is exemplified as comprising a touch screen 201 indicating a plurality of touchable control areas. The touch screen 201 as exemplified comprises the touchable control areas "seat forwards" 210, "seat backwards" 211, "rotate seat clockwise" 212, "rotate seat counter-clockwise" 213, "tilt seat forwards" 214, "tilt seat backwards" 215, "raise seat" 216 and "lower seat" 217. However, it will be appreciated that the control unit 200 may comprise more or fewer touchable control areas than those indicated above for controlling the movement (i.e. translational and/or rotational movement) of the seat 120. Furthermore, the control unit 200 may comprises one or more knobs, or the like, for controlling the movement of the seat 120. A control of the movement of the seat 120 may be exemplified as follows: by pressing the control area "seat forwards" 210, the actuation system 140 is commanded to move the seat 120 on the telescopic element 110 along the horizontal axis x between a retracted position of the seat 120 within the bathing enclosure 101 and an extended position of the seat 120 outside the bathing enclosure 101. Analogously, by pressing the control area "seat backwards" 211, the actuation system 140 is commanded to move the seat 120 on the telescopic element 110 along the horizontal axis x between an extended position of the seat 120 outside the bathing enclosure 101 and a retracted position of the seat 120 inside the bathing enclosure 101. Furthermore, by pressing the control area(s) "rotate seat clockwise" 212 and/or "rotate seat counter-clockwise" 213, the actuation system 140 is commanded to rotate the seat 120 (counter) clockwise in the direction A in the horizontal x-y plane in the Cartesian coordinate system. Furthermore, by pressing the control area(s) "tilt seat forwards" 214 and/or "tilt seat backwards" 215, the actuation system 140 is commanded to tilt the seat 120 in the direction C relative to the vertical axis z in the Cartesian coordinate system. Furthermore, by pressing the control area(s) "raise seat" 216 or "lower seat" 217, the actuation system 140 is commanded to raise or lower the seat 120, in its extended position, along the vertical axis z.

Figure 5:
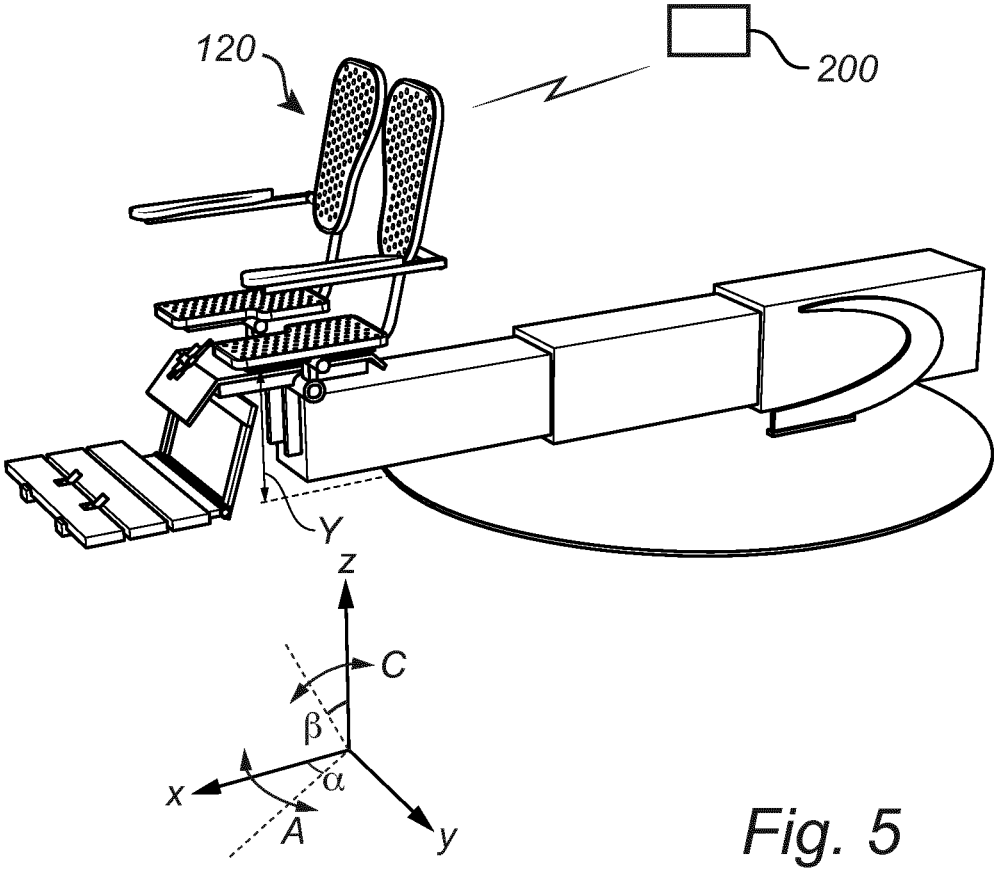
FIG. 5 shows a schematic illustration of a movement of the seat of the bathing aid according to an embodiment of the present invention.

FIG. 5 shows a schematic illustration of a movement of the seat 120 of the bathing aid 100 by means of the control unit 200. The coupling between the control unit 200 and the actuation system for moving the seat may be comprise a wired or wireless coupling. The control unit 200 is only schematically indicated, as it may be arranged at substantially any position inside our outside the bathing aid. FIG. 5 shows the seat 120 in its extended position, in which the control unit 200 according to an embodiment is configured to position the seat 120 according to a predetermined positioning of the seat 120. Here, the predetermined positioning of the seat 120 is exemplified as comprising a rotation of the seat 120 to an angle $\alpha$ in the direction A in the horizontal x-y plane in the Cartesian coordinate system, a tilt of the seat 120 to an angle $\beta$ in the direction C with respect to the vertical axis z and a raising (lowering) of the seat 120 to a height $\gamma$. It will be appreciated that the predetermined positioning of the seat 120 may comprise one or more of the parameters $\alpha$, $\beta$ and $\gamma$.

Figure 6:
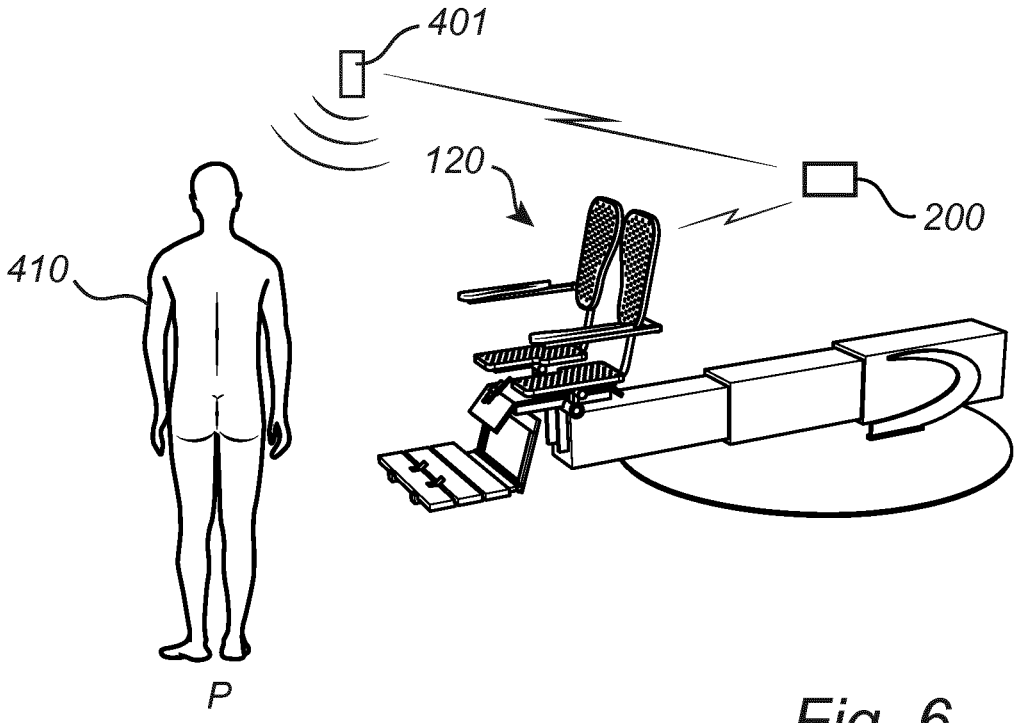
FIG. 6 shows a schematic illustration of a bathing aid comprising a detection unit according to an embodiment of the present invention.

FIG. 6 shows a schematic illustration of a detection unit 401 communicatively coupled to the control unit 200. The detection unit 401 is configured to detect the position P of a person 410 in relation to the seat 120, whereby the control unit 200 is configured to position the seat 120 according to the detected position P of the person 410. For example, the control unit 200 may be configured to position the seat 120 at a specific length along the horizontal axis x, at a specific degree of rotation $\alpha$, degree of tilt $\beta$ and/or height $\gamma$ according to FIG. 5 for an even more convenient access of a person 410 standing in position P. Furthermore, the control unit 200 may be configured to stop the seat 120 as a function of the detected position P of the person 410, e.g. during the movement of the seat 120 from its retracted to its extended position, such that a collision between the seat 120 and the person 140 may be avoided. It will be appreciated that the detection unit 401 may comprise any device(s) and/or arrangement(s) for the detection of (a) person(s) and/or (an) object(s), e.g. one or more sensors, transmitters, receivers, etc. The detection unit 401 may be arranged separately from the bathing aid 100, or alternatively, be arranged substantially anywhere on the bathing aid 100. For example, the detection unit 401 may be arranged on the seat 120. It should be noted that the operation of one or more of the devices such as sensors, transmitters and/or receivers is known to the skilled person, and a more detailed description thereof is hereby omitted.

Figure 7:
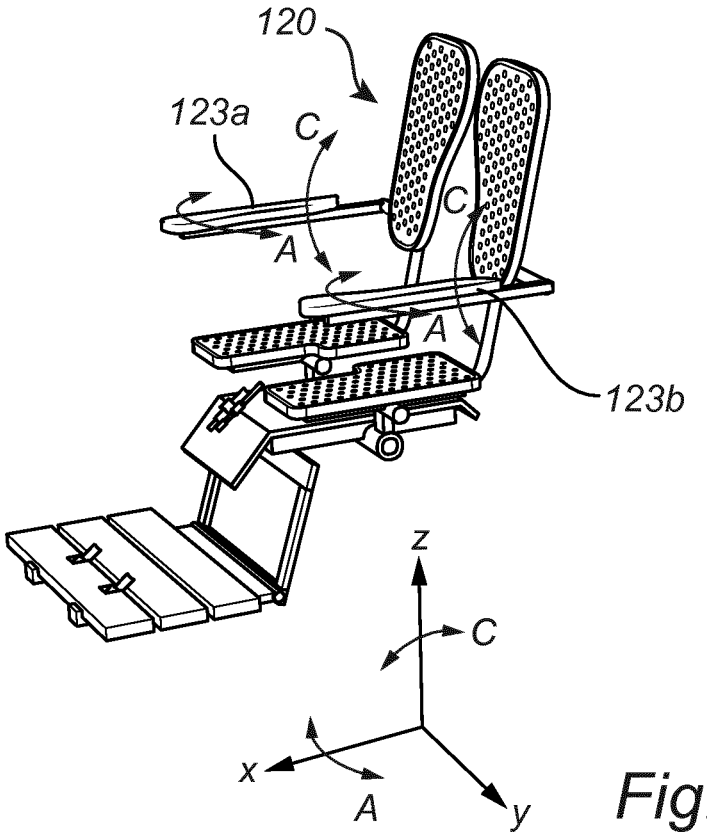
FIGS. 7-8 show schematic illustrations of a seat of a bathing aid according to embodiments of the present invention.
Figure 8:
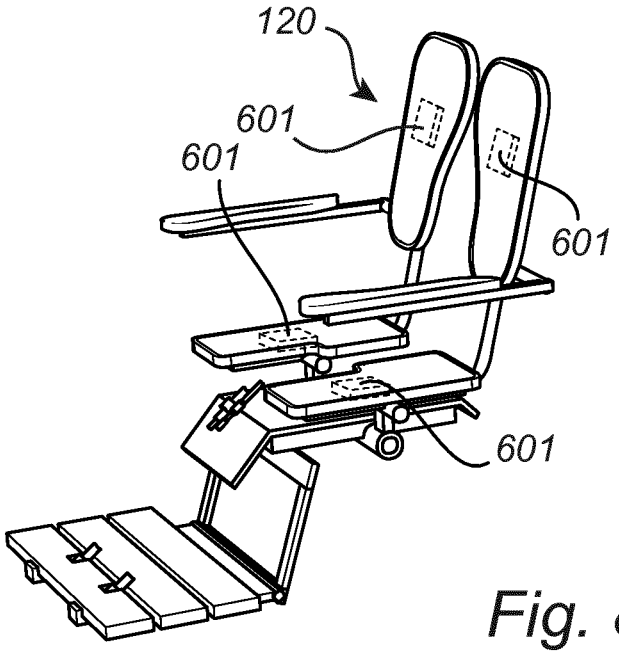

FIGS. 7-8 show schematic illustrations of a seat 120 according to embodiments of the present invention.

In FIG. 7, the seat 120 comprises two armrests 123*a,b* arranged along the horizontal axis x in the Cartesian coordinate system alongside the seat 120, and the actuation system is configured to move and/or turn one or both armrest(s) 123*a,b* between the horizontal axis x and a second direction which is different from the horizontal axis x. For example, the actuation system 140 may be configured to move one or both armrest(s) 123*a,b* in the direction A in the horizontal x-y plane, i.e. to lift and/or turn one or both armrest(s) 123*a,b* outwards from the seat 120. It will be appreciated that the actuation system may be configured to move and/or turn one or both armrest(s) 123*a,b* as a function of a detected position of a person according to FIG. 6. For example, if a person stands on the left (right) hand side of the seat 120, the actuation system may be configured to lift and/or turn the left (right) armrest for a convenient access of the person to the seat 120. Furthermore, the actuation system 140 may be configured to move one or both armrest(s) 123*a,b* in the direction C with respect to the vertical axis z in the Cartesian coordinate system, i.e. to lift or lower one or both armrest(s) 123*a,b* upwards or downwards from the seat 120. The seat 120 in FIG. 7 may furthermore comprise at least one collision sensor (not shown) configured to sense the presence and/or position of an object (e.g. a person) and configured to avoid a collision between at least a portion of the seat 120 and the object. For example, the seat 120 may comprise (a) collision sensor(s) configured to avoid a collision between at least a portion of the seat 120 and a person intending to take a bath and/or shower. As yet another example, the seat 120 may comprise one or more collision sensors configured to avoid a collision between one or both armrest(s) 123*a,b* and a person. More specifically, in the case the actuation system is configured to move the armrest(s) 123*a,b* of the seat 120, the collision sensor(s) may be configured to avoid a collision between the armrest(s) 123*a,b* and the person. Consequently, the collision sensor(s) hereby mitigate an impact between the armrest(s) 123*a,b* and the person and/or a squeezing, pinching and/or clamping of the person by the armrest(s) 123*a,b*.

In FIG. 8, the seat 120 comprises a plurality of weight sensors 601 for sensing the weight of a person sitting on the seat 120. Here, the weight sensors 601 are distributed in the seat 120 such that the weight sensors 601 may determine the distribution of the weight of the person sitting on the seat 120. It will be appreciated that the number, size and/or placement of the weight sensors 601 may vary. Furthermore, and according to an embodiment of the present invention, the weight sensors 601 may be communicatively coupled to the actuation system, and the actuation system may hereby be configured to move the seat 120 as a function of (or based on) the weight sensed by the weight sensors 601 of a person sitting on the seat 120. For example, the bathing aid may be configured to determine if a person sits correctly or incorrectly on the seat 120. In case the bathing aid determines that a person sits correctly on the seat 120 it may be configured to move the seat 120 accordingly. However, in case the bathing aid determines that a person sits incorrectly on the seat 120 it may be configured to stop the movement of the seat 120 due to safety reasons.

Figure 9:
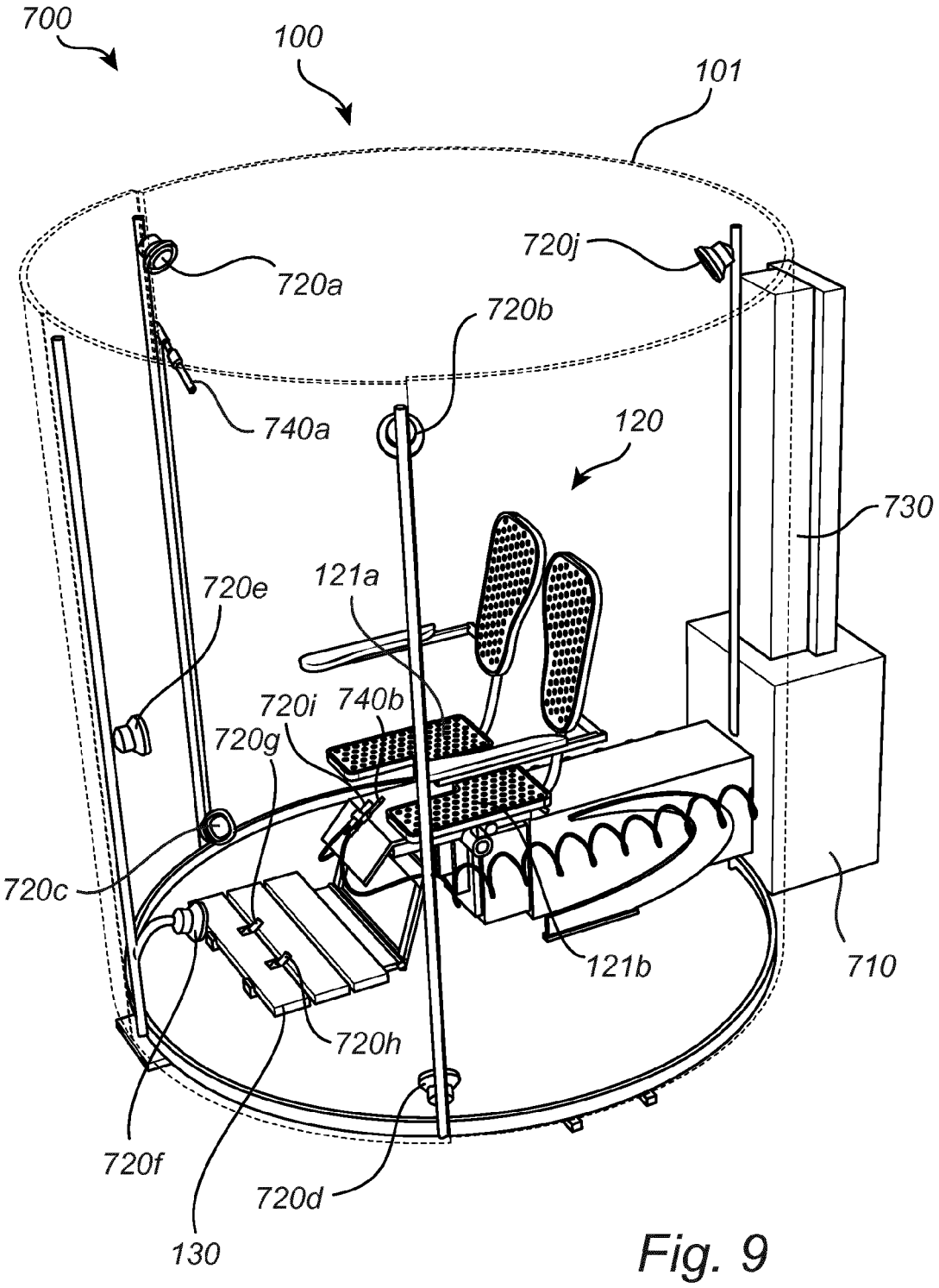
FIG. 9 shows a schematic illustration of a bathing arrangement according to an embodiment of the present invention.

FIG. 9 shows a schematic illustration of a bathing arrangement 700 according to an embodiment of the present invention. The bathing arrangement 700 comprises a bathing aid 100 according to any one of the aforementioned embodiments. Furthermore, the bathing aid 100 comprises a schematically indicated water supply system 710 for a supply of water to the bathing enclosure 101. It will be appreciated that the bathing arrangement 700 may be constructed or designed as a shower, wherein the supplied water may flow out through a floor drain arranged in the bathing enclosure 101. Alternatively, the bathing arrangement 700 may be constructed or designed as a bath, wherein the supplied water may fill up the bathing enclosure 101 to a desired and/or predetermined water level. It will be appreciated that the water supply system 710 may comprise a water source such as a tap of a bathtub, shower, wash basin, or the like, which may be provided in the (bath) room where the bathing aid 100 is arranged. The water supply system 710 may further comprise one or more conduit(s), pump(s), etc., for a supply of water to the bathing enclosure 101. It should be noted that a more detailed description of the arrangement of the water supply system 710 is omitted.

The bathing arrangement 700 in FIG. 9 further comprises a plurality of water nozzles 720 which are arranged within the bathing enclosure 101. The water nozzles 720 are arranged to spray water on a person sitting on the seat 120 of the bathing aid 100 for the purpose of cleaning said person. In the bathing arrangement 700 as exemplified, there are ten water nozzles 720*a-i* arranged within the bathing enclosure 101. Water nozzles 720*a* and 720*b* are arranged on the front left and right hand side, respectively, of the bathing enclosure 101 and at relatively high positions with respect to the bathing enclosure 101 such that they are arranged to spray water obliquely downwards towards on a person sitting on the seat 120. For example, the water nozzles 720*a* and 720*b* may be arranged to spray water on the chest and/or torso of a person sitting on the seat 120. Accordingly, water nozzles 720*c* and 720*d* are arranged on the front left and right hand side, respectively, of the bathing enclosure 101 and at relatively low positions with respect to the bathing enclosure 101 such that they are arranged to spray water obliquely upwards towards on a person sitting on the seat 120. Water nozzles 720*e* and 720*f* are arranged in a vertical sequence on the front side of the bathing enclosure 101 such that they are arranged to spray water on the torso, thighs, legs and/or feet of a person sitting on the seat 120. Water nozzles 720*g* and 720*h* are arranged on the footrest 130 of the seat 120 such that they are arranged to spray water on the foot soles of a person sitting on the seat 120. Water nozzle 720*i* is arranged in (or in a vicinity of) the space defined by the two separated parts 121*a,b* of the seat 120. Water nozzle 720*i* is hereby arranged to spray water obliquely upwards towards a genital, perianal and/or intergluteal area of a person sitting on the seat 120. It will be appreciated that water nozzle 720*i* may be of special importance for washing/cleaning the lower abdomen of women, as water from the water nozzle 720*i* may spray in a direction from the vaginal area towards the perianal or intergluteal area. Water nozzle 720*j* is arranged on the back side of the bathing enclosure 101 such that it is arranged to spray water on the back of a person sitting on the seat 120. The bathing arrangement 700 may further comprise a manually operable shower head (not shown) arranged within the bathing enclosure 101 for a convenient shower operation, if desired and/or needed, by a person sitting on the seat 120.

In FIG. 9, the bathing arrangement 700 further comprises product supply system 730 for a supply of a body cleaning product (e.g. soap, shampoo, etc.) to the bathing enclosure 101. The product supply system 730, which is arranged separately from the water supply system 710, comprises a container in which the body cleaning product is stored. The product supply system 730 may further comprise one or more conduit(s), coupling(s), pump(s), etc., for a supply of body cleaning product to the bathing enclosure 101. The product supply system 730 further comprises a plurality of body cleaning product nozzles 740 which are arranged within the bathing enclosure 101. The body cleaning product nozzles 740 (hereafter denoted soap nozzles 740) are arranged to spray a body cleaning product (e.g. soap, shampoo, etc.) from the container on a person sitting on the seat 120 of the bathing aid 100 for the purpose of cleaning said person. In the bathing arrangement 700 as exemplified in FIG. 9, there are two soap nozzles 740*a* and 740*b* arranged within the bathing enclosure 101. Soap nozzle 740*a* is arranged on the front side of the bathing enclosure 101 and at a relatively high position with respect to the bathing enclosure 101 such that the soap nozzle 740*a* is arranged to spray a body cleaning product obliquely downwards towards on a person sitting on the seat 120. For example, the soap nozzle 740*a* may be arranged to spray a body cleaning product on the chest and/or torso of a person sitting on the seat 120. Soap nozzle 740*b* is arranged in (or in a vicinity of) the space defined by the two separated parts 121*a,b* of the seat 120. Soap nozzle 740*b* is hereby arranged to spray a body cleaning product obliquely upwards towards a genital, perianal and/or intergluteal area of a person sitting on the seat 120.

It will be appreciated that one or more of the water nozzles 720*a-j* and the soap nozzles 740*a-b* may be adjustable with respect to its angle of inclination. Furthermore, the water nozzles 720*a-j* and the soap nozzles 740*a-b* may comprise a bayonet coupling. The pressure in the water nozzles 720*a-j* and the soap nozzles 740*a-b* is approximately 4-6 bar.

Figure 10:
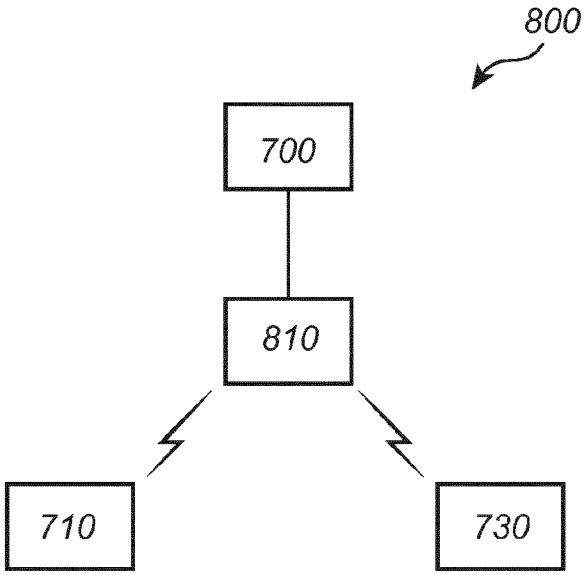
FIG. 10 shows a schematic illustration of a bathing system according to an embodiment of the present invention.

FIG. 10 shows a schematic illustration of a bathing system 800 according to an embodiment of the present invention. The bathing system 800 comprises a bathing arrangement 700 according to any previously described embodiment. In FIG. 10, the bathing arrangement 700 comprises both a water supply system 710 and a product supply system 730. The bathing system 800 further comprises a control system 810 which is communicatively coupled (by wire or wirelessly) to the water supply system 710 and/or to the product supply system 730. The control system 810 is hereby configured to control the supply of water and/or body cleaning product to the bathing enclosure of the bathing arrangement 700. The control system 810 may be automatic and may furthermore be configured to control the supply of water and/or body cleaning product according to a predetermined cleaning program. For example, the predetermined cleaning program may include a supply of water and/or body cleaning product wherein the amount, flow and/or temperature of the water and/or body cleaning product is set in advance. For example, the predetermined cleaning program may be formed such that a person sitting on the seat of the bathing aid of the bathing arrangement may in a first stage of the cleaning program be showered (washed, sprayed) with water by one or more of the water nozzles of the bathing arrangement. Then, in a second stage of the cleaning program, the person may accordingly be showered (washed, sprayed) with a body cleaning product (e.g. soap) by one or more of the soap nozzles of the bathing arrangement. Then, in a third stage of the cleaning program, the person may again be showered with water.

The control system 810 may alternatively be manually operable by the person using and/or intending to use the bathing aid, or be operable by any other person, such as an assistant, on the outside of the bathing enclosure. The control system 810 may for example be communicatively coupled to and/or integrated with the control unit 200 according to any previous embodiment. For example, the control system 810 may be integrated with the control unit 200 arranged on the seat 120 (e.g. on an arm rest 123*a,b*) for a convenient control by the person sitting on the seat 120. Hence, the control unit 200 may furthermore comprise functions of the control system 810 related to the supply of water and/or body cleaning product. For example, the touch screen 201 as previously exemplified may further comprise one or more touchable control areas (or knobs) to control the supply of the amount of, the temperature of and/or time periods of water or body cleaning product. For example, the touch screen 201 may comprise touchable control areas such as "water", "time", "soap", "temperature", etc. Alternatively, instead of touchable control areas, functions of the control system 810 related to the supply of water and/or body cleaning product may be controllable by buttons, switches, or the like.

Figure 11:
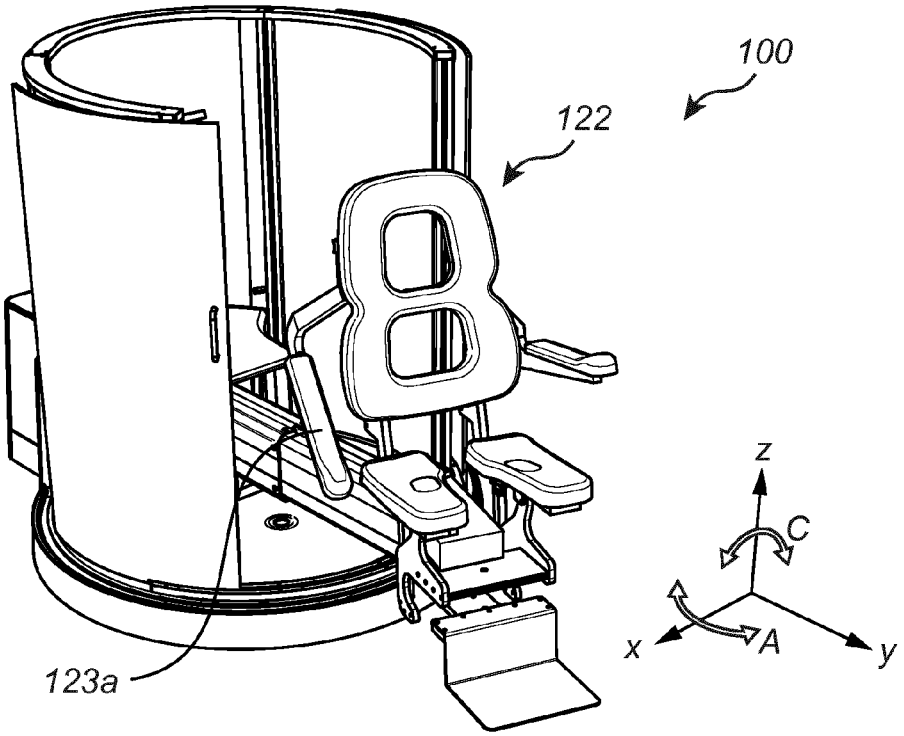
FIG. 11 shows a schematic illustration of a bathing aid according to an embodiment of the present invention.

FIG. 11 shows another schematic illustration of a bathing aid 100 according to the present invention. It will be appreciated that several references of the bathing aid in FIG. 1 have been omitted in FIG. 11 for clarity reasons, and it is hereby referred to FIG. 1. The seat 122 of the bathing aid 100 in FIG. 11 is in its extended position outside the bathing enclosure. In this extended position of the seat 122, the actuation system has rotated (A) the seat 122 in a horizontal plane (x-y). Furthermore, the actuation system has tilted (C) the seat 122 with respect to a vertical axis (z). In FIG. 11, the actuation system has furthermore moved the right armrest 123*a* downwards in the direction C with respect to the vertical axis z, i.e. lowered the right armrest 123*a* from the seat 120. It should be noted that the possibility of the bathing aid 100 of the present invention to rotate and/or tilt the seat, as well as raising and/or lowering one or both armrests, is beneficial for elderly and/or handicapped persons who need a convenient and safe access to the bathing aid 100. This is especially the case for persons who suffer from a stroke, as the left or the right side of the body may be affected.

Even though the invention has been described with reference to specific exemplifying embodiments thereof, many different alterations, modifications and the like will become apparent to those skilled in the art after studying this description. The described embodiments are therefore not intended to limit the scope of this invention. For example, the size and/or shape of one or more of the part, portions and/or elements of the bathing aid 100 such as the bathing enclosure 101, the seat 120, the telescopic element 110, etc. may be different that that shown or indicated. Furthermore, the number, positioning of one or more of the part, portions and/or elements of the bathing aid 100 such as the water nozzles 710 and/or the soap nozzles 720 may be different than that shown.

The invention claimed is:

1. A bathing aid, comprising:

a bathing enclosure;

a telescopic element arranged at least partially within the bathing enclosure, wherein the telescopic element is configured to be extendable and retractable along a horizontal axis;

a seat configured to support a person, wherein the seat is arranged on the telescopic element; and an actuation system coupled to the telescopic element and the seat, wherein the actuation system is configured to move the seat on the telescopic element along the horizontal axis between a retracted position of the seat that is within the bathing enclosure and an extended position of the seat that is outside the bathing enclosure, wherein the actuation system, when the seat is in the extended position, is configured to rotate the seat in a horizontal plane and is configured to tilt the seat with respect to a vertical axis, and wherein the bathing enclosure comprises a side wall that is configured to open and close, and wherein the actuation system is configured to open the side wall before the seat is moved from the retracted position of the seat that is within the bathing enclosure to the extended position of the seat that is outside the bathing enclosure, and the actuation system is configured to close the side wall when the seat has been moved from the extended position of the seat that is outside the bathing enclosure to the retracted position of the seat that is within the bathing enclosure.

2. The bathing aid of claim 1, wherein the actuation system is configured to move the seat in the extended position along the vertical axis.

3. The bathing aid of claim 1, further comprising at least one control unit communicatively coupled to the actuation system, wherein the control unit is configured to control the movement of the seat.

4. The bathing aid of claim 3, wherein the at least one control unit in the extended position of the seat, is configured to position the seat according to a predetermined positioning of the seat.

5. The bathing aid of claim 3, wherein the at least one control unit is configured to manually operate the movement of the seat.

6. The bathing aid of claim 5, wherein the at least one control unit is arranged on the seat, and the control unit is configured to be manually operable by a person sitting on the seat.

7. The bathing aid of claim 3, further comprising a detection unit communicatively coupled to the at least one control unit, wherein the detection unit is configured to detect the position of a person in relation to the seat, and the control unit is configured to position the seat according to the detected position of the person.

8. The bathing aid of claim 1, wherein the seat comprises at least one armrest arranged in a first direction alongside the seat, and the actuation system is configured to move the armrest between the first direction and a second direction different from the first direction.

9. The bathing aid claim 1, wherein the seat comprises at least one weight sensor configured to sense a weight of a person sitting on the seat.

10. The bathing aid of claim 9, wherein the weight sensor is communicatively coupled to the actuation system, and wherein the actuation system is configured to move the seat based on the weight of the person sitting on the seat.

11. A bathing arrangement, comprising:

a bathing aid comprising:

a bathing enclosure;

a telescopic element arranged at least partially within the bathing enclosure, wherein the telescopic element is configured to be extendable and retractable along a horizontal axis;

a seat configured to support a person, wherein the seat is arranged on the telescopic element;

an actuation system coupled to the telescopic element and the seat, wherein the actuation system is configured to move the seat on the telescopic element along the horizontal axis between a retracted position of the seat that is within the bathing enclosure and an extended position of the seat that is outside the bathing enclosure, wherein the actuation system, in the extended position of the seat, is configured to rotate the seat in a horizontal plane and is configured to tilt the seat with respect to a vertical axis, and wherein the bathing enclosure comprises a side wall that is configured to open and close, and wherein the actuation system is configured to open the side wall before the seat is moved from the retracted position of the seat that is within the bathing enclosure to the extended position of the seat that is outside the bathing enclosure, and the actuation system is configured to close the side wall when the seat has been moved from the extended position of the seat that is outside the bathing enclosure to the retracted position of the seat that is within the bathing enclosure; and a water supply system configured to provide a supply of water to the bathing enclosure.

12. The bathing arrangement of claim 11, further comprising a product supply system configured to provide a supply of at least one body cleaning product to the bathing enclosure.

13. The bathing arrangement of claim 11, wherein the bathing arrangement comprises at least one nozzle arranged within the bathing enclosure that is configured to clean a person sitting on the seat of the bathing aid.

14. A bathing system, comprising:

a bathing arrangement comprising:

a bathing enclosure;

a telescopic element arranged at least partially within the bathing enclosure, wherein the telescopic element is configured to be extendable and retractable along a horizontal axis;

a seat configured to support a person, wherein the seat is arranged on the telescopic element;

an actuation system coupled to the telescopic element and the seat, wherein the actuation system is configured to move the seat on the telescopic element along the horizontal axis between a retracted position of the seat that is within the bathing enclosure and an extended position of the seat that is outside the bathing enclosure, wherein the actuation system, in the extended position of the seat, is configured to rotate the seat in a horizontal plane and is configured to tilt the seat with respect to a vertical axis, and wherein the bathing enclosure comprises a side wall that is configured to open and close, and wherein the actuation system is configured to open the side wall before the seat is moved from the retracted position of the seat that is within the bathing enclosure to the extended position of the seat that is outside the bathing enclosure, and the actuation system is configured to close the side wall when the seat has been moved from the extended position of the seat that is outside the bathing enclosure to the retracted position of the seat that is within the bathing enclosure;

a water supply system configured to provide a supply of water to the bathing enclosure; and a product supply system configured to provide a supply of at least one body cleaning product to the bathing enclosure; and a control system communicatively coupled to the water supply system and to the product supply system, wherein the control system is configured to control the supply of the water and the body cleaning product to the bathing enclosure.

* * * * *